US007900758B2

(12) United States Patent
King et al.

(10) Patent No.: US 7,900,758 B2
(45) Date of Patent: Mar. 8, 2011

(54) CARRY-ON CASE FOR CONFORMING TO THE CURVED SHAPE OF AN OVERHEAD CARRY-ON LUGGAGE COMPARTMENT

(75) Inventors: William L. King, Swansea, MA (US); John H. Sullivan, Jr., Englewood, CO (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 10/589,631

(22) PCT Filed: Feb. 9, 2005

(86) PCT No.: PCT/US2005/004197

§ 371 (c)(1),
(2), (4) Date: Sep. 4, 2008

(87) PCT Pub. No.: WO2005/079265

PCT Pub. Date: Sep. 1, 2005

(65) Prior Publication Data

US 2009/0008203 A1 Jan. 8, 2009

(51) Int. Cl.
*A45C 3/00* (2006.01)

(52) U.S. Cl. ..... 190/112; 190/115; 190/903; 190/110

(58) Field of Classification Search ..... 190/109, 190/110, 111, 112, 903; 224/645, 652, 653, 224/654, 655

See application file for complete search history.

(56) References Cited

U.S. PATENT DOCUMENTS

| | | | | | |
|---|---|---|---|---|---|
| 1,921,110 | A | | 8/1933 | Wheary | |
| 2,180,191 | A | * | 11/1939 | Bauch | 190/111 |
| 2,209,781 | A | | 7/1940 | Lewis | |
| 2,470,367 | A | | 5/1947 | Palma | |
| 2,718,943 | A | | 9/1955 | Braverman | |
| 2,985,265 | A | * | 5/1961 | Gehrie | 190/113 |
| 4,081,061 | A | * | 3/1978 | Tucker | 190/108 |
| 4,244,632 | A | | 1/1981 | Molinari | |
| 4,538,861 | A | | 9/1985 | Hughes, Jr. | |
| 5,004,134 | A | * | 4/1991 | Barry | 224/650 |
| 5,083,645 | A | * | 1/1992 | Lee | 190/113 |
| 5,295,565 | A | | 3/1994 | Latshaw | |
| 5,407,112 | A | * | 4/1995 | Christodoulou et al. | 224/153 |
| 5,515,954 | A | | 5/1996 | Nordstrom | |
| D374,773 | S | | 10/1996 | Domotor | |

(Continued)

FOREIGN PATENT DOCUMENTS

FR 2577773 A3 8/1986

OTHER PUBLICATIONS

International Search Report, PCT/US2005/004197, dated Aug. 3, 2005.

(Continued)

*Primary Examiner* — Tri M Mai
(74) *Attorney, Agent, or Firm* — Dorsey & Whitney LLP

(57) ABSTRACT

A carry-on case (2) comprising a packing compartment (12) defined by a lower textile panel (16) and a zipper track (8) that extends along a bottom edge of the packing compartment (12). Packing compartment is accessible from the top of the case (2) via a three sided zipper track (8) extending along the top edge, right, and left sides of the packing compartment (12) to permit all-sided access therein.

15 Claims, 11 Drawing Sheets

U.S. PATENT DOCUMENTS

| | | | | | |
|---|---|---|---|---|---|
| 5,560,483 | A | | 10/1996 | Sequin | |
| 5,630,521 | A | * | 5/1997 | Waddell et al. | 190/18 A |
| 5,671,831 | A | | 9/1997 | Chiu | |
| 5,676,223 | A | * | 10/1997 | Cunningham | 190/109 |
| D387,198 | S | * | 12/1997 | Lehmann et al. | D3/217 |
| 5,788,032 | A | | 8/1998 | Krulik | |
| 5,875,876 | A | | 3/1999 | Wang | |
| 5,944,155 | A | * | 8/1999 | Geary | 190/108 |
| 5,984,154 | A | * | 11/1999 | Scicluna | 224/153 |
| 6,109,403 | A | | 8/2000 | Godshaw | |
| D431,903 | S | * | 10/2000 | Worley et al. | D3/232 |
| 6,213,267 | B1 | | 4/2001 | Miller | |
| D459,579 | S | * | 7/2002 | Kegels | D3/279 |
| 6,431,334 | B1 | * | 8/2002 | Lin | 190/120 |
| 6,467,594 | B1 | * | 10/2002 | Wu | 190/108 |
| 6,547,070 | B1 | | 4/2003 | Kolpin | |
| 6,604,617 | B2 | | 8/2003 | Davis et al. | |
| D485,681 | S | * | 1/2004 | Fenton et al. | D3/279 |
| 2002/0108828 | A1 | | 8/2002 | Soskin | |
| 2003/0015559 | A1 | | 1/2003 | Oh | |
| 2009/0050429 | A1 | | 2/2009 | Adams | |
| 2009/0127046 | A1 | | 5/2009 | King et al. | |

OTHER PUBLICATIONS

Notice of Allowance, U.S. Appl. No. 10/589,632, dated Mar. 10, 2010.

Notice of Allowance, U.S. Appl. No. 10/589,632, dated Dec. 4, 2009.

Response to Office Action, U.S. Appl. No. 10/589,632, dated Aug. 26, 2009.

Office Action, U.S. Appl. No. 10/589,632, dated May 27, 2009.

Notice of Allowance, U.S. Appl. No. 10/589,632, dated Jun. 30, 2010.

* cited by examiner

CARRY-ON CASE FOR CONFORMING TO THE CURVED SHAPE OF AN OVERHEAD CARRY-ON LUGGAGE COMPARTMENT

BACKGROUND OF THE INVENTION

This invention relates to carry-on luggage cases, specifically luggage cases designed to fit in most aircraft overhead compartments. More particularly, this invention relates to carry-on luggage cases that take full advantage of the space available in the rather wedged-shaped overhead compartments positioned on the extreme port and starboard sides of the passenger compartment where the airplane fuselage causes those overhead compartments to taper sharply along their back most or rear most locations. Tapering carry-on cases have been known in the art. For example, U.S. design Pat. D374773 to Domotor, also assigned to the assignee of the subject invention, illustrates such a tapering case. However, full advantage of this shape has been unavailable since the passenger would have to remove this case from the overhead compartment to access books, laptop computers, etc., packed therein.

It is an object of this invention to provide a carry-on luggage case that conforms to the shape of the aircraft's overhead compartments while allowing a traveler to easily access the case's contents without having to remove it from the overhead compartment.

DETAILED DESCRIPTION OF THE PREFERRED EMBODIMENT

Figure 15:
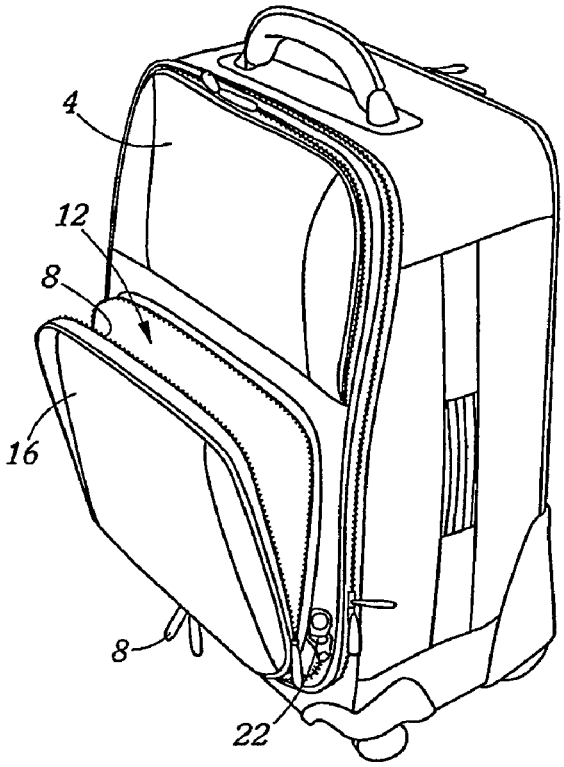
FIG. 15 is a perspective view of the carry-on case illustrating access to the all-sides accessible pocket from the top.
Figure 17:
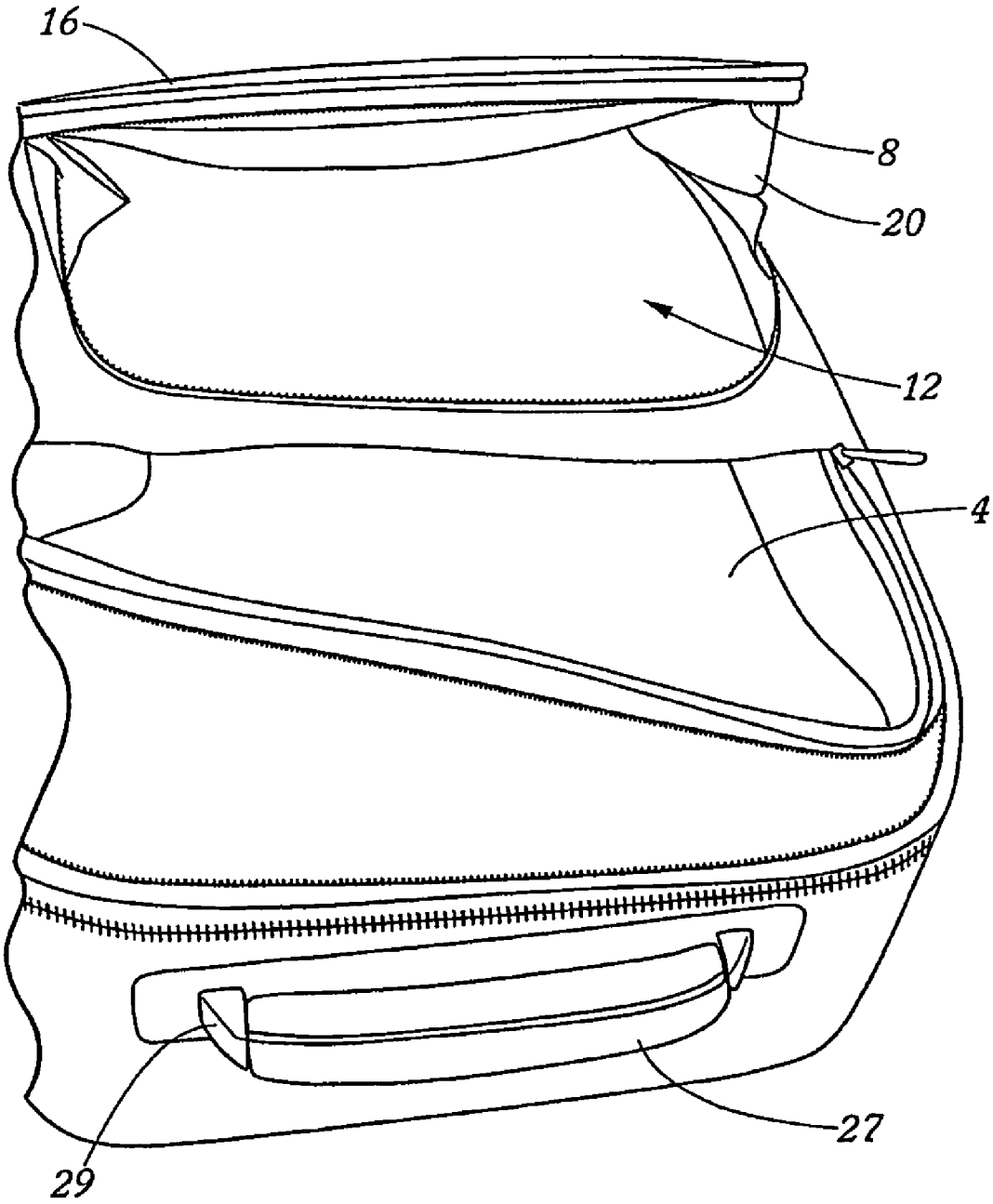
FIG. 17 is a top view of the carry-on case with both the all-sides accessible pocket and the main compartment lid in an open condition.

Accordingly, we have invented a new configuration of such a case including a generally rectangular shaped luggage case body 2 with a tapering front top portion 4 that mimics the tapering shape of the port or starboard overhead compartments in a typical commercial airline. Of course, it should be understood by one of ordinary skill in the art that case 2 can comprise any type of storage and/or transport vessel, including backpacks, messenger bags, totes, purses, briefcases, or any other type of storage and/or transport device. Tapering front top portion 4 houses an upper pocket that is enclosed on three sides (the top, left, and right sides) by access zipper 8. The tapering front portion pocket 4 also includes a gusset (not shown) that allows the pocket to outwardly expand and to prevent the contents therein from spilling out of the sides. This case 2 further includes a special gusseted "all-sides accessible" pocket 12 located on the front lower portion of the carry-on case 2. This all-sides accessible pocket 12 has an access zipper 8 that extends fully around three sides of this pocket 12 (namely the top, left, and right sides as seen in FIGS. 15 and 17). Access zipper 8 is opened and closed by a pair of zipper sliders 10 that permits a traveler to position closure of all-sides accessible pocket 12 in any location along access zipper 8.

The case 2 is constructed in the known manner using a fabric, preferably textile fabric, outer covering. Plastic sheets stabilize the overall shape of the case 2 and castor wheels 26 and carry handles 24 and/or towing handle 32 permit the case 2 to be transported on a set of four corner mounted wheels 26 as shown in the figures. Of course, case 2 may be exclude wheels. Furthermore, case 2 may be transported by other means such as by shoulder straps, backpack straps, or other means, the case 2 either having wheels or not having wheels.

Figure 5:
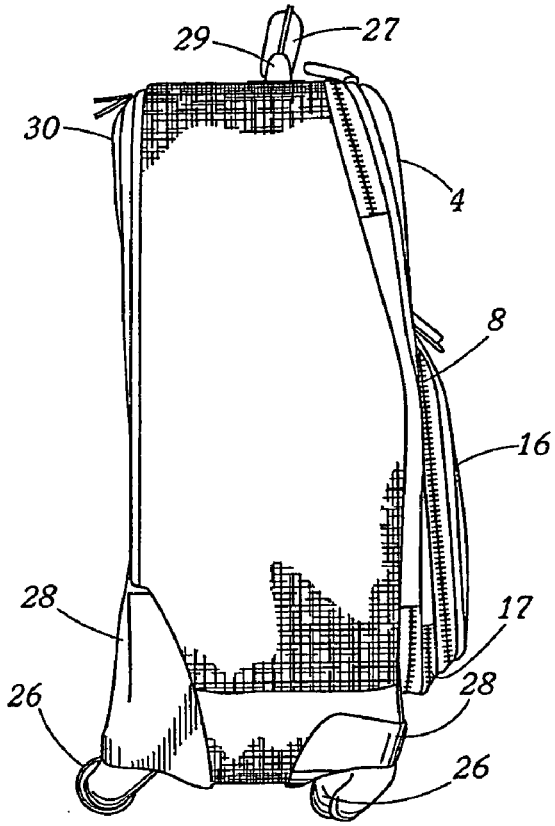
FIG. 5 is a left side view thereof.
Figure 6:
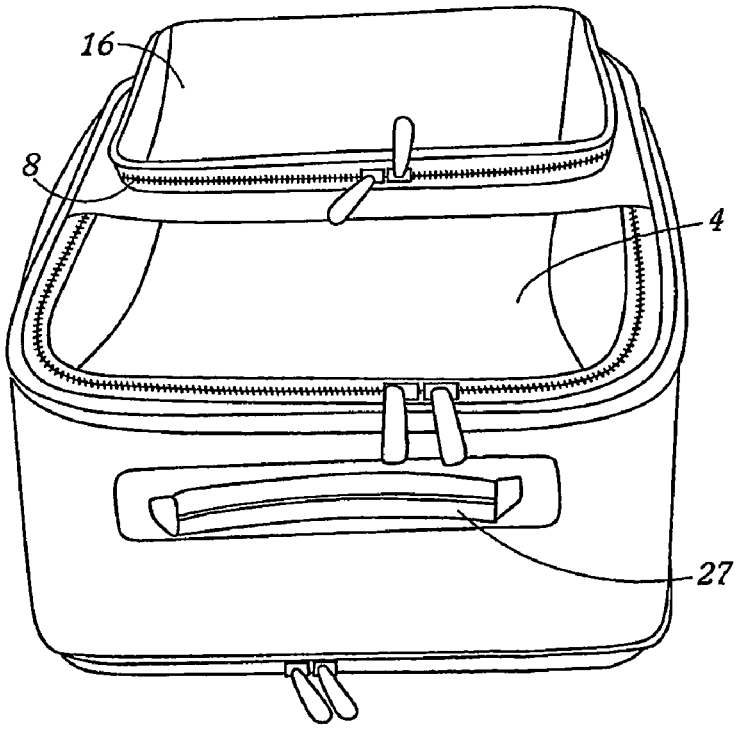
FIG. 6 is a top view of the carry-on case.

Referring to FIG. 5, all-sides accessible pocket 12 is located on the front lower portion of carry-on case 2. All-sides accessible pocket 12 is defined by a lower textile panel 16 and textile gusset 17. Construction of the case 2 is typical and construction techniques are well known throughout the luggage industry, using polyethylene sheet to give resilient stiffness to various components of the case 2. It should be understood by one of ordinary skill in the art that alternate materials could be used in the construction of case 2, including polypropylene sheets with a honeycomb cross-section, aluminum, wood, or any other kind of material. Textile gusset 17 provides expandability to the base portion of all-sides accessible pocket 12. All-sides accessible pocket 12 can of course also be accessed from the top end of carry-on case 2 via access zipper 8. All-sides accessible pocket 12 comprises a gusset 20 that allows expansion of pocket 12, while at the same time prevents the items stored therein from spilling out of the sides. The all-sides accessible pocket 12 is secured by a securing feature 22. The distinct advantage of all-sides accessible pocket 12 is accessibility of carry-on case 2 while carry-on case 2 is stored in the overhead compartment of the airplane. Thusly, when carry-on case 2 is removed from the airplane's overhead compartment and set upright, it is important that a securing feature 22 be incorporated into the design of all-sides accessible pocket 12 so that the contents of pocket 12 remain safely stored. In the preferred embodiment of the present invention, securing feature 22 comprises an oversized zipper slider 23 that includes a keyhole through which a hook and snap lock 25 is threaded. The hook and snap lock 25 is of a substantial size and noticeable, shiny texture, so that a traveler can easily see the securing feature 22 and is therefore reminded to secure the contents of the all-sides accessible pocket 12 by fastening the securing feature 22. Of course, many other different types of securing means can be used to secure all-sides accessible pocket 12. For example, all-sides accessible pocket 12 could be secured by a system of hook and loop fasteners, buttons, a system of straps and slots, or any other securing means. Of course, all pockets incorporated into the design of the present invention could further include dividers, additional inner pouches, specialty pouches such as small pouches designed for personal digital assistants and/or cellular phones, or other organizing features.

Figure 1:
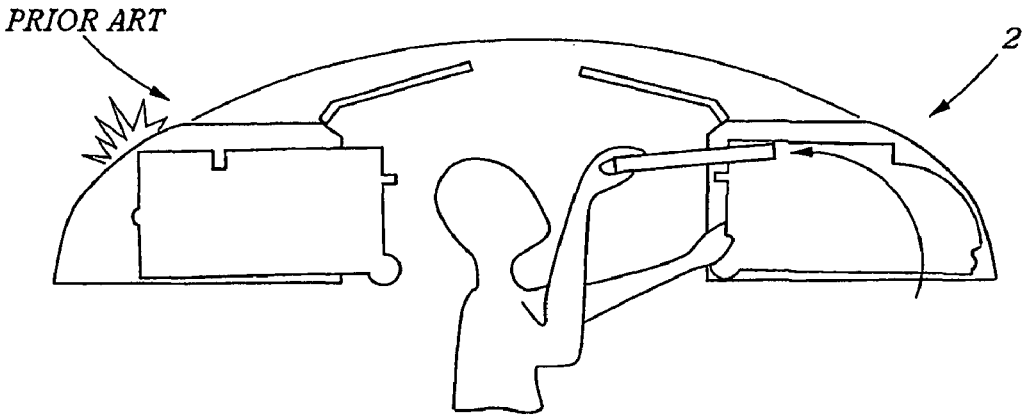
FIG. 1 is a diagram showing the prior art carry-on case and a carry-on case in accordance with the claimed invention.
Figure 2:
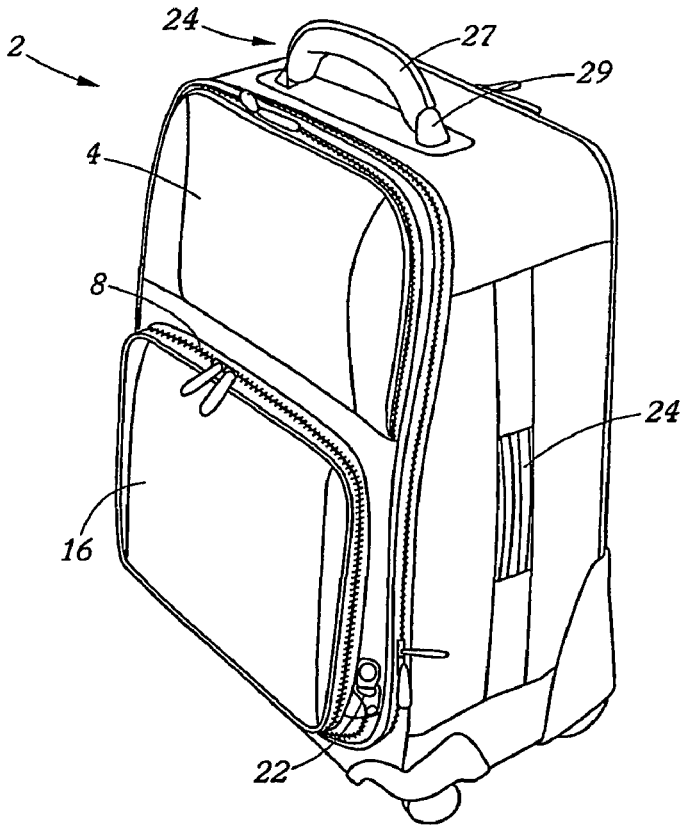
FIG. 2 is a perspective view of a preferred form of that carry-on case.
Figure 3:
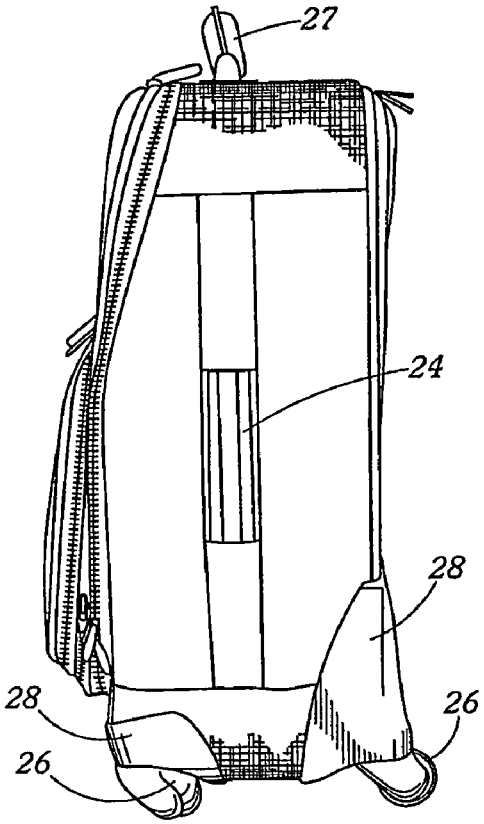
FIG. 3 is a right side view thereof.
Figure 4:
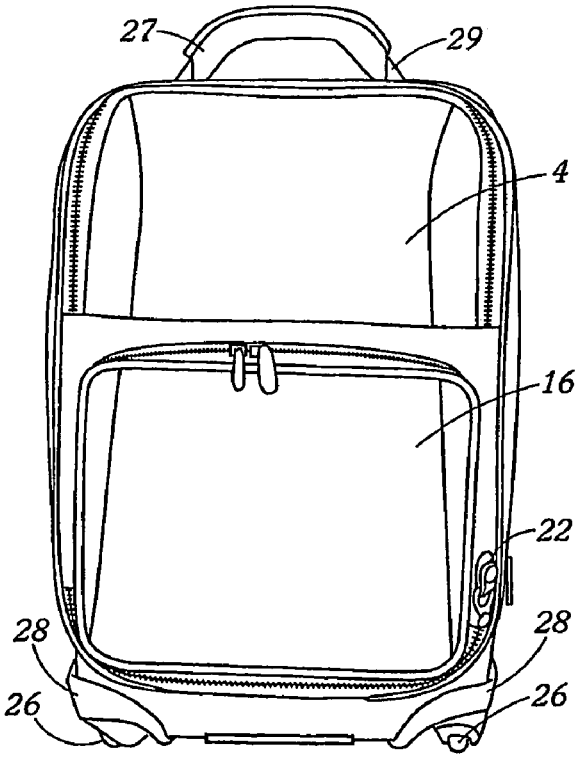
FIG. 4 is a front view thereof.
Figure 7:
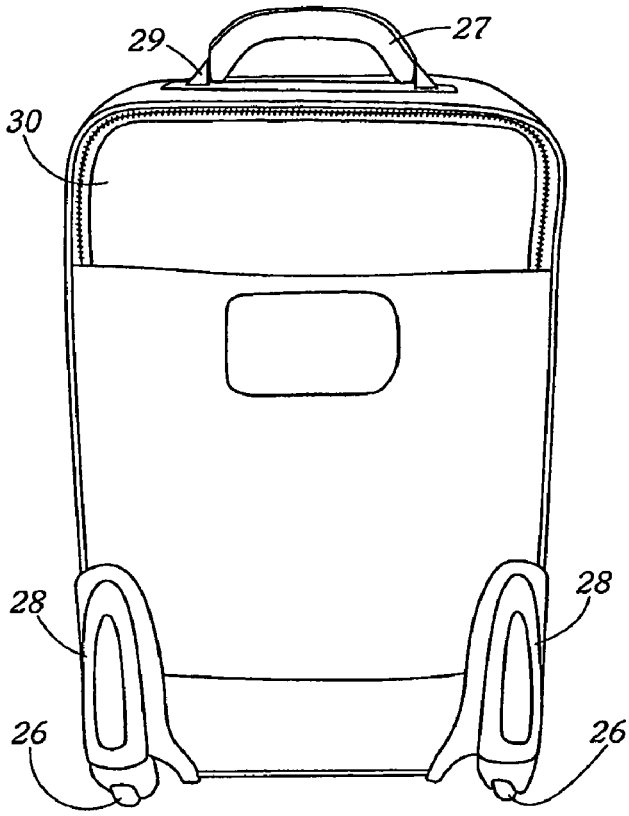
FIG. 7 is a back view thereof.
Figure 16:
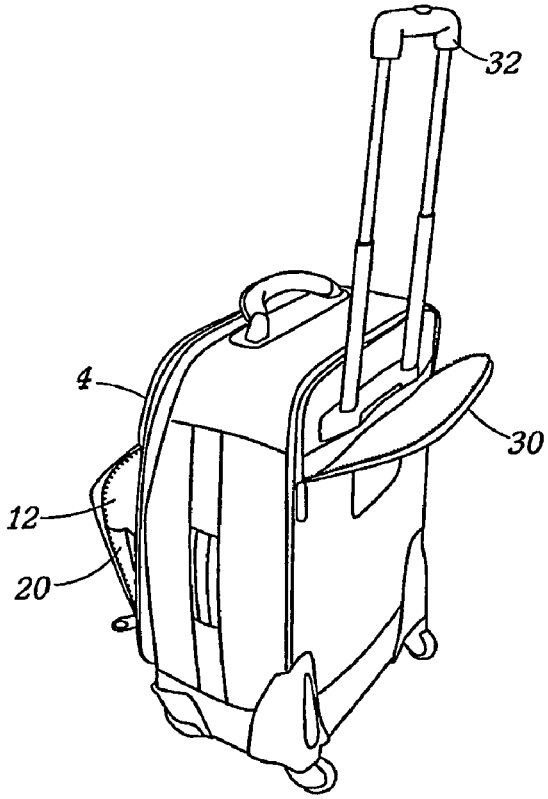
FIG. 16 is perspective view of the back side of the carry-on case showing a back pocket that houses an extensible towing mechanism.

FIG. 3 illustrates two carry handles 24. An upper carry handle 24 is positioned on the top surface of carry-on case 2 to allow for easy lifting when carry-on case 2 is upright. The upper carry handle 24 is comprised of a rotating grip portion 27 that rotates within a bracket portion 29. The rotating handle portion 27 is surrounded by genuine leather. The side carry handle 24 is provided to ease lifting when the carry-on case 2 is placed on its side. Side carry handle 24 comprises a strip of sturdy, laminate material that is aesthetically surrounded by the textile material used in the rest of carry-on case 2. Also shown in FIG. 3 are wheels 26. Carry-on case 2 includes four spinner wheels that are of castor type. Of course, wheels 26 could comprise any type of wheel including conventional corner mounted wheels. The carry-on case 2 is buffered by plastic guards 28. Guards 28 comprise contoured, hard plastic that are mounted and wrapped around each of the four lower corners of carry-on case 2 and prevent the corners from being scuffed or torn. The tapered design of rear guards 28 creates a protective base on which the carry-on case 2 may rest upon being laid down. Referring to FIG. 7, carry-on case 2 comprises a back pocket 30 that houses a towing handle 32 (shown in FIG. 16).

Figure 8:
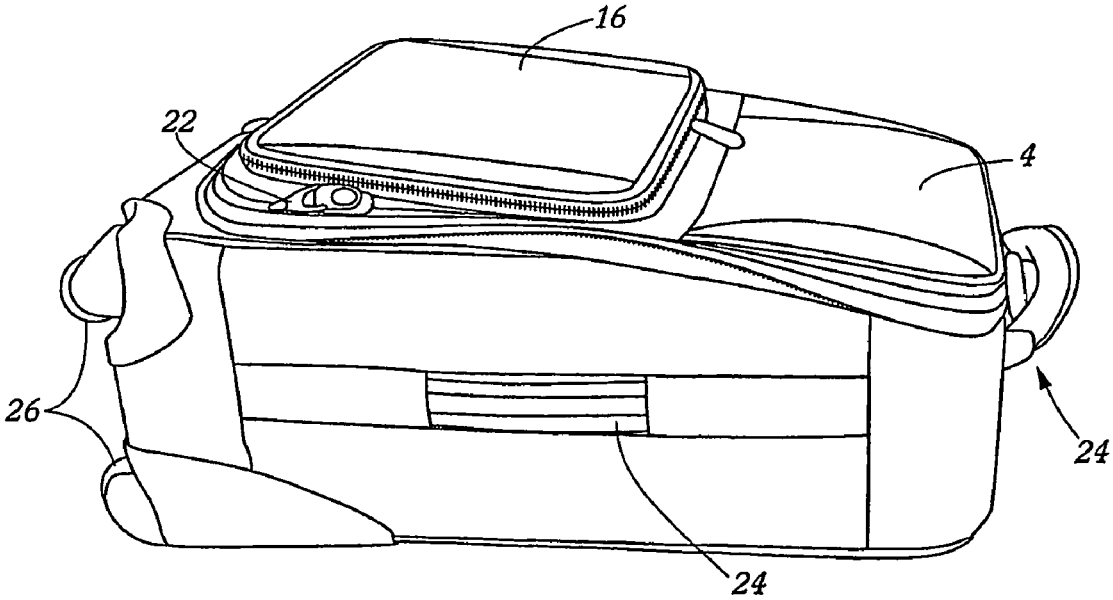
FIG. 8 is a view of the carry-on case in its stowed position with the tapered upper portion inserted first into the overhead compartment leaving the bottom portion exposed to the inner surface of the door of the overhead compartment such that the traveler can access the contents of the case that are stored within an "all-sides accessible" pocket.

FIG. 8 illustrates the carry-on case 2 as it would appear having been stored in an aircraft overhead compartment. Note how the carry-on case 2 tapers substantially in order to utilize the curved shape of the overhead bin. The carry-on case 2 is therefore extremely convenient for carry-on travel.

Figure 9:
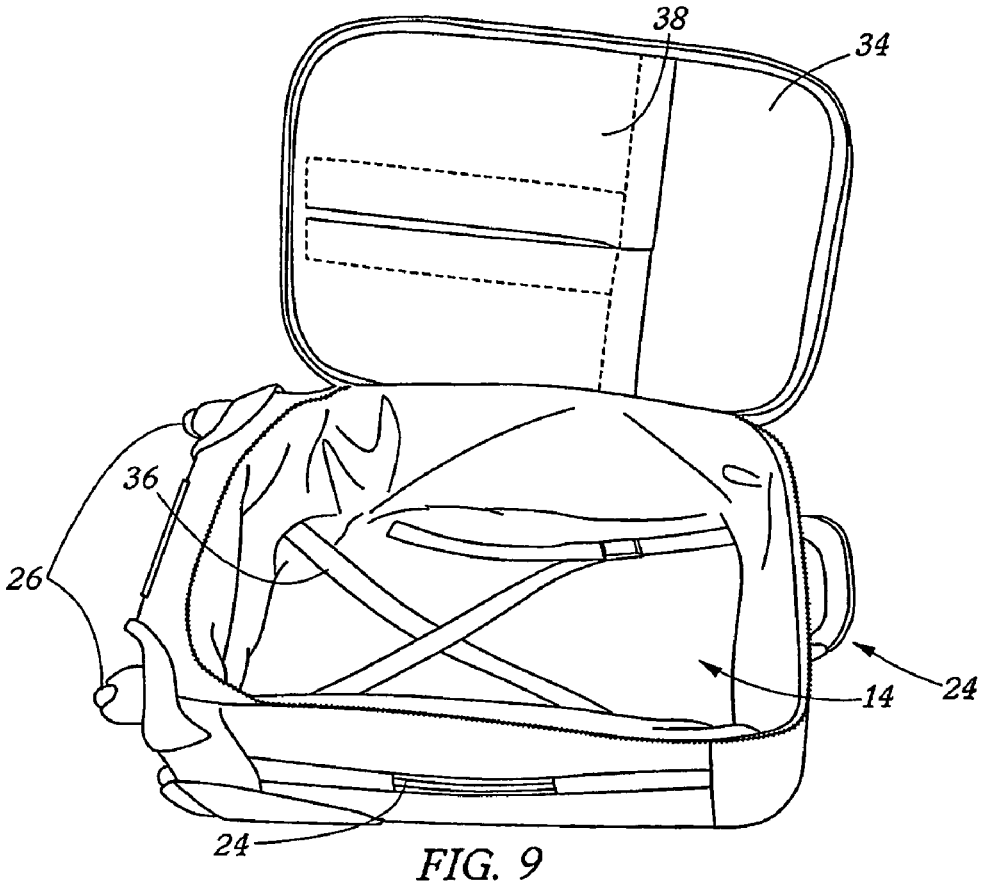
FIG. 9 is a similar view thereof with a self-hinging lid fully open to expose the entire main packing compartment.
Figure 10:
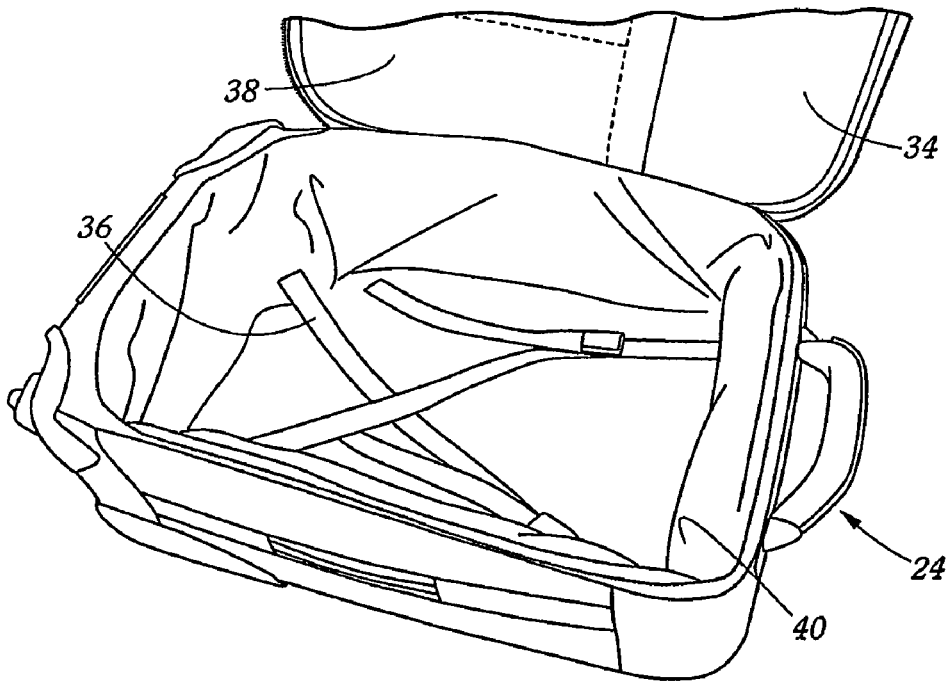
FIG. 10 is a closer view thereof.
Figure 11:
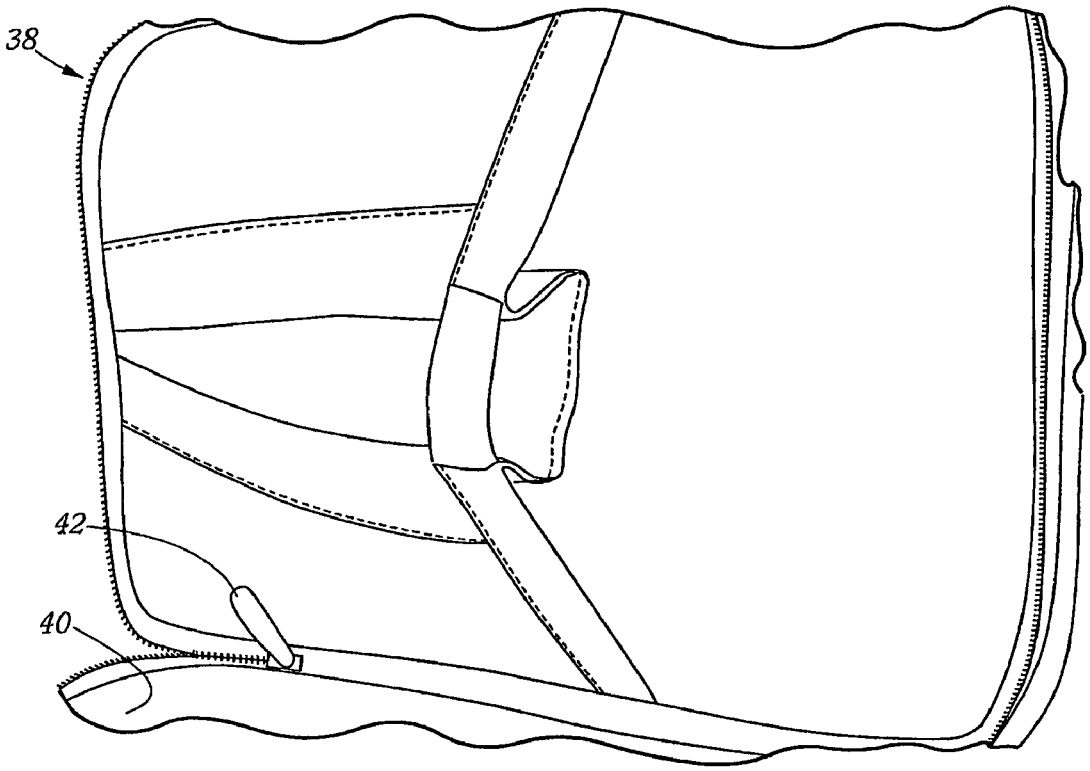
FIG. 11 is a close-up view of an organizational feature located on the inside surface of the lid.
Figure 12:
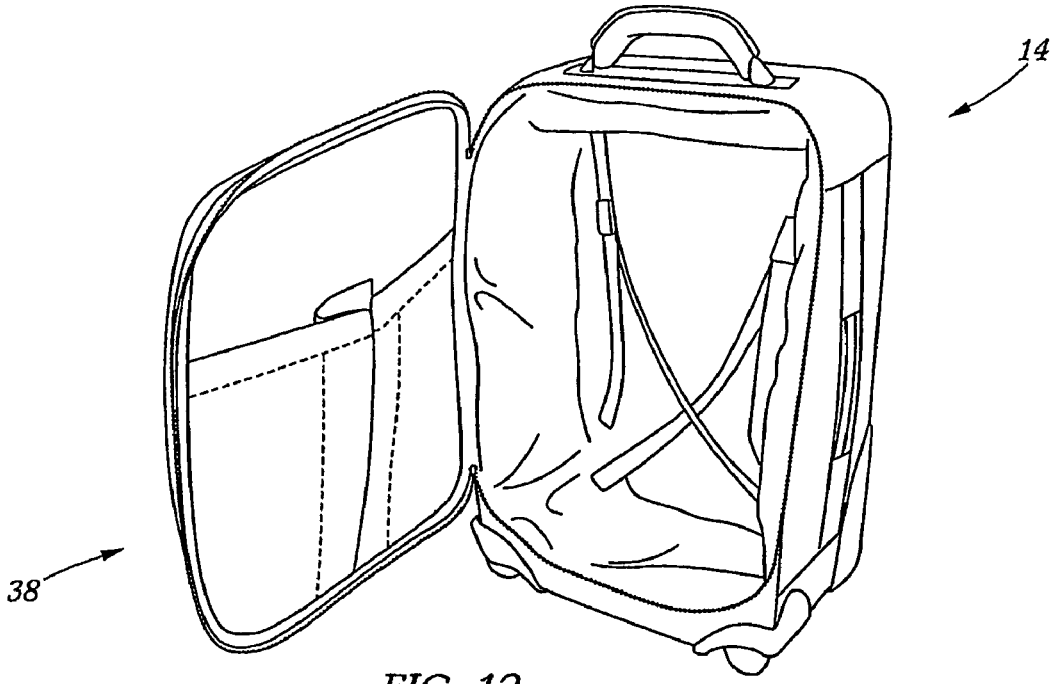
FIG. 12 is a perspective view of the carry-on case in upright position with the lid open.

FIG. 9 is a view of the carry-on case 2 in a packing configuration with a lid 34 open. Referring to FIG. 9, the main packing compartment 14 is of a substantial size. Main packing compartment 14 may include such organizational features as securing straps 36 or other additional features. For example, such additional features could include a suiter, including the Samsonite Tri-Fold Removable Suiter that helps reduce wrinkling, side pockets, side securing straps or other features. Also shown in FIG. 9 is an organizational feature 38 placed on the inner surface of lid 34. Organizational feature 38, as more closely shown in FIG. 11, comprises an expandable pouch that allows for extra storage. Organizational feature 38 can include a large mesh pocket attached to the inner surface of lid 34 via an elastic band that allows for the expansion of organizational feature 38. An attractive liner 40 lines the main packing compartment 14 of carry-on case 2. Liner 40 comprises four holes through which the securing straps 36 are fed. A liner zipper 42, as shown in FIG. 11, allows the liner 40 to be removed so that the securing straps 36, if unused by the traveler, can be retracted from the main packing compartment 14 and stored below liner 40. Other organization features can be incorporated into the design of the main packing compartment 14 as well as to all other parts of the case 2. For example, the main packing compartment 14 could include a removable or permanent organizational feature that separates items.

Figure 13:
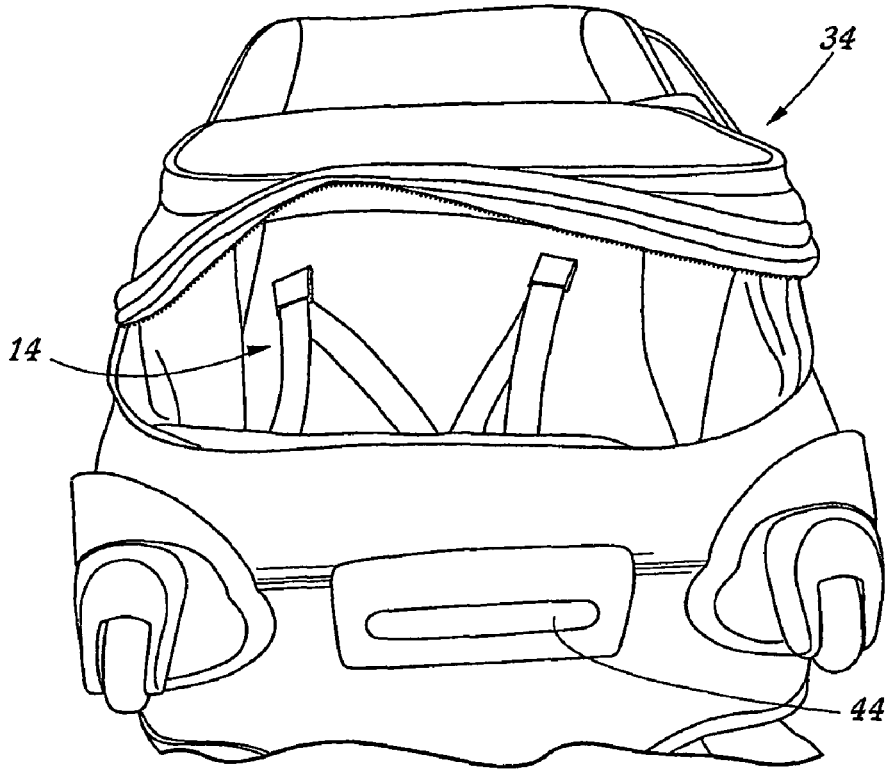
FIG. 13 is a bottom view of the carry-on case that illustrates how the main packing compartment can be easily accessed even when the carry-on is in a stowed position.
Figure 14:
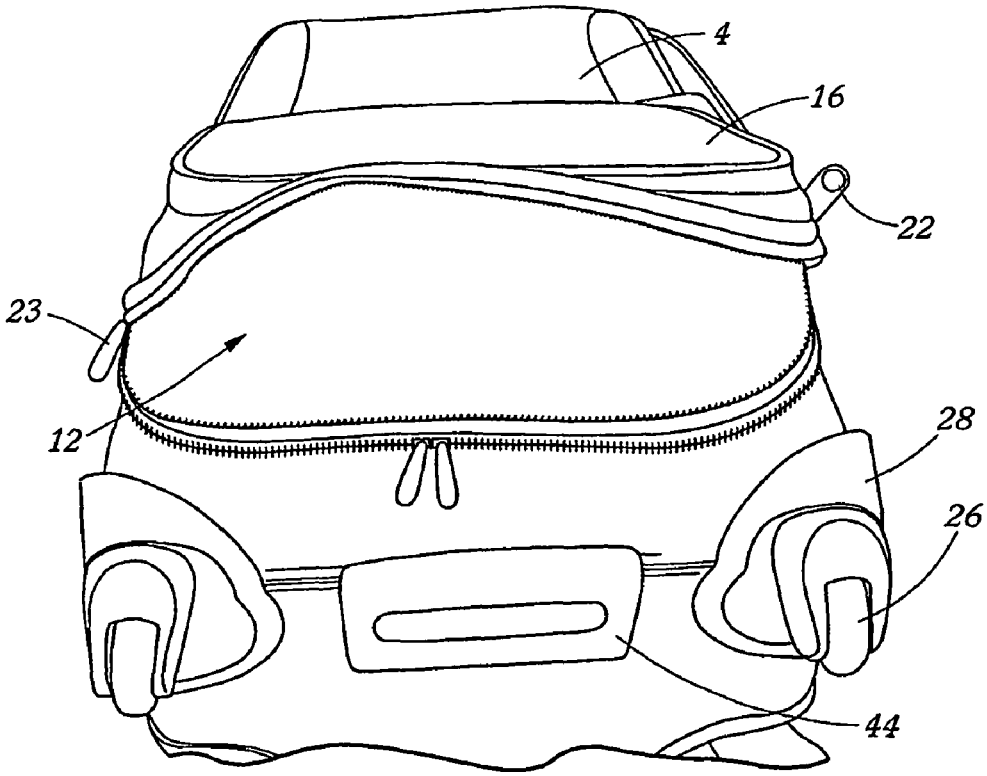
FIG. 14 is a bottom view of the carry-on case that illustrates the utilization of the all-sides accessible pocket.

FIG. 13 illustrates a bottom view of carry-on case 2 and shows the ease of accessibility into main packing compartment 14 via lid 34. Lid 34 is self-hinged along the left side of carry-on case 2. Because the hinge is of a relatively short length, a traveler may gain access into carry-on case 2 via the top portion or bottom portion of carry-on case 2 simply by unzipping access zipper 8. This permits a traveler to access their items from the top or bottom of the case 2 while it is being stowed in either the overhead bin or under the forward passenger seat. Similarly, the all-sides accessible pocket 12 creates easy access to the case 2. FIG. 14 illustrates the ease by which a traveler can insert or remove items from the all-sides accessible pocket 12. Referring to FIG. 14, the securing feature 22 has been disengaged allowing oversized zipper slider 23 to be unzipped.

Another feature of the present invention is a bottom grip 44 as shown in FIG. 13. Bottom grip 44 comprises a recess sized to receive a human hand. The recess is lined by a hard plastic and eases the lifting of carry-on case 2. For example, a traveler could lift carry-on case 2 by placing their left hand within bottom grip 44 and their right hand around carry handle 24.

FIG. 17 illustrates a top view of the carry-on case 2 while it is lying down. The tapering front top portion 4 is easily accessed as is the all-sides accessible pocket 12 when the carry-on case is stored facing the traveler. In addition, the main packing compartment 14 can be accessed simply by opening access zipper 8. Therefore, the carry-on case 2 can be stored in the overhead compartment in a forward facing fashion. This makes the storage of carry-on case 2 versatile, as access to the case contents is very easy no mater what configuration the carry-on case 2 is stored. The carry-on case 2 can therefore be stored in a forward or rearward configuration in either the overhead bins, under the forward passenger seat, or in any other location on the aircraft and still be accessed easily by the traveler.

Figure 19:
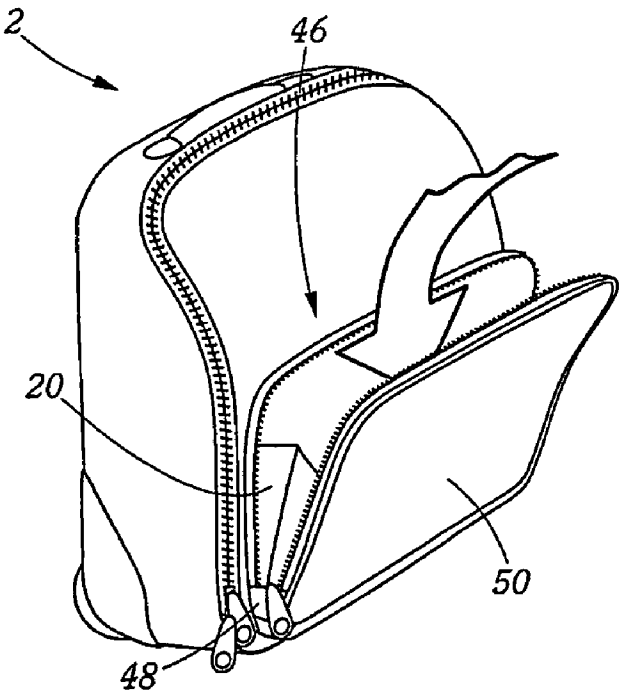
FIGS. 18 and 19 show the operation of an all-sided accessible pocket that is incorporated into the design of an alternate embodiment of the claimed invention.
Figure 18:
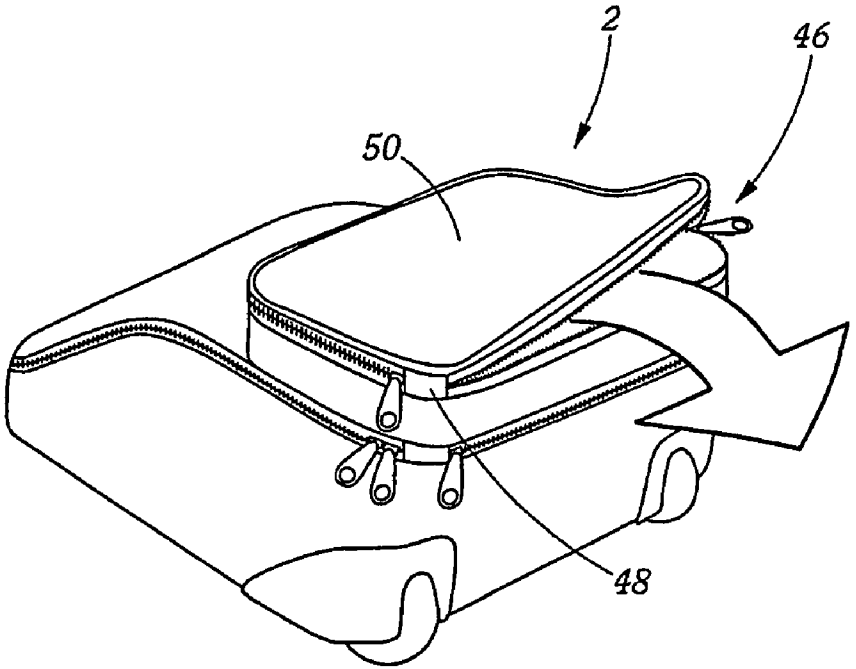
Figure 20:
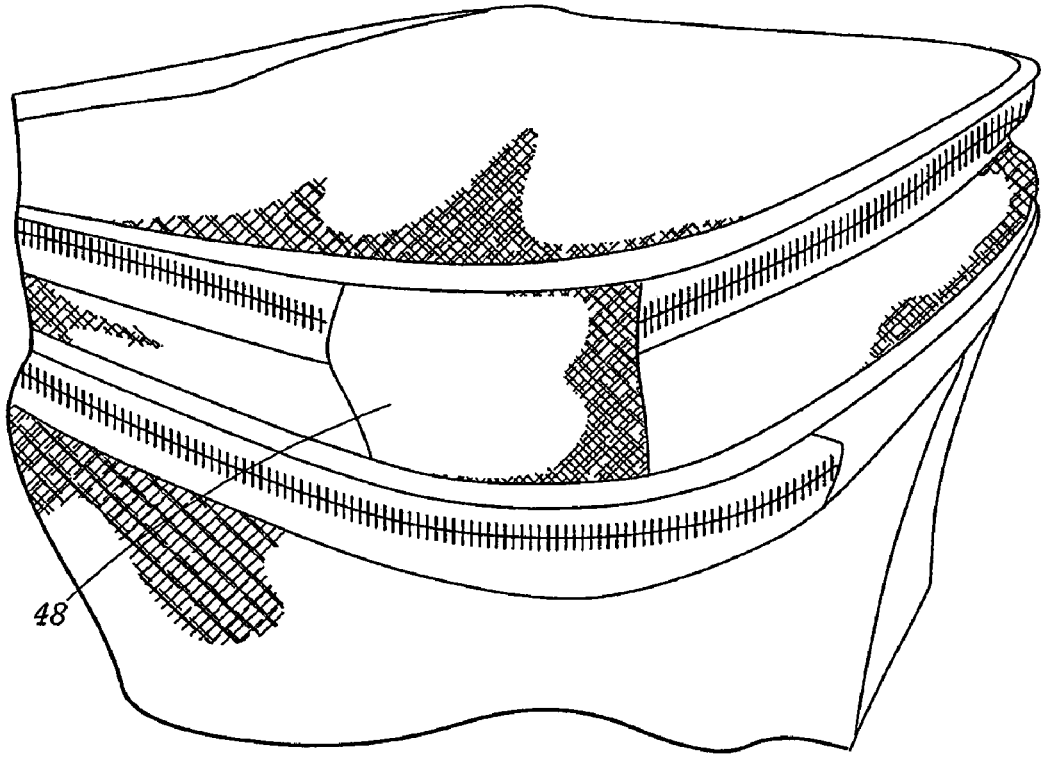
FIG. 20 is a perspective view of a bottom left corner of the carry-on case shown in FIGS. 18 and 19.
Figure 21:
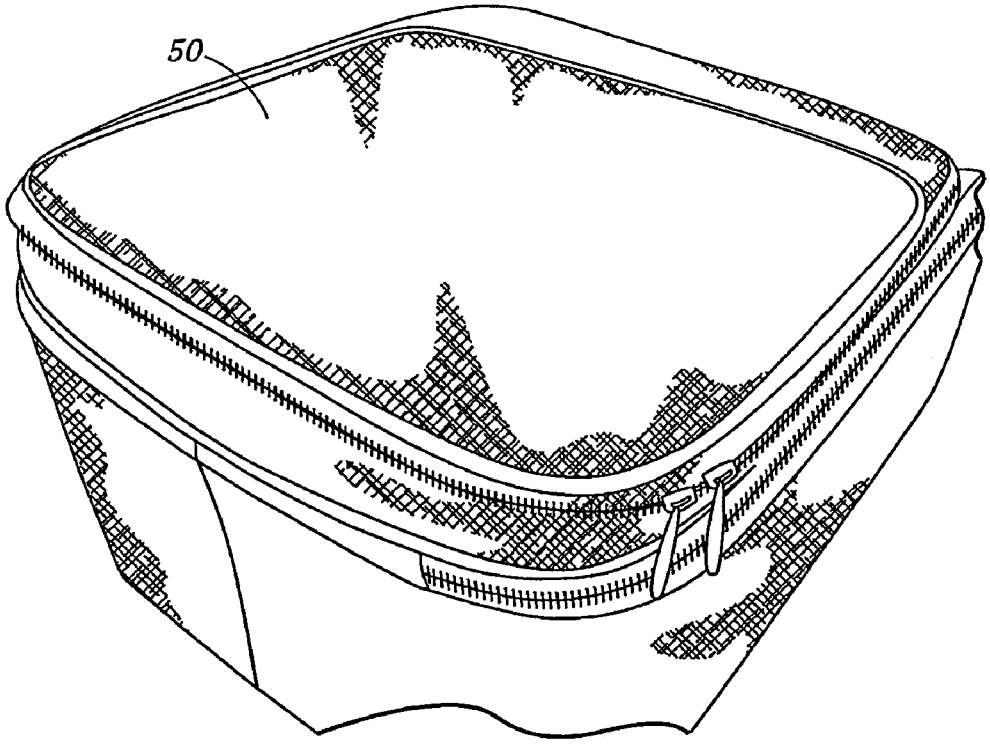
FIG. 21 is a perspective view of a bottom right corner of the carry-on case shown in FIGS. 18 and 19.

FIGS. 18 through 21 illustrate a second embodiment of the present invention. Referring to FIG. 18, an all-sided accessible pocket 46 is shown. Referring to FIG. 18, the all-sided accessible pocket 46 is made possible by a self-hinging textile panel 48 that is approximately 2 inches in length. Self-hinging textile panel 48 is affixed directly to an all-sided accessible panel 50. This very small hinge connection 48 permits access to the interior of all-sided accessible pocket 46 from all normal sides of the pocket including a top side, both the vertical sides, and from the bottom side as well. This is an important feature of carry-on case 2 because it permits the traveler to store the carry-on case 2 in a secure location in an overhead compartment or under a seat while still being able to access the contents of all-sided accessible pocket 46 without removing the carry-on case 2 from its secure location. Preferably, the side portions of all-sided accessible pocket 46 also include a folding gusset panel 20, one of which is shown in FIG. 19. FIG. 20 illustrates the self-hinging textile panel 48 in a closer view. The lower right hand side of all-sided accessible panel 50 is shown in greater detail in FIG. 21.

Although the present invention has been described with a certain degree of particularity, it is understood that the present disclosure has been made by way of example, and changes in detail or structure may be made without departing from the spirit of the invention as defined in the appended claims.

We claim:

1. A carry-on case comprising:

a body including a main packing compartment and a lid that provides access to the main packing compartment;

a pocket defined by the lid and a panel spaced apart from the lid, a top edge that extends between the lid and the panel, a bottom edge that extends between the lid and the panel, and two spaced apart edges, each extending between the lid and the panel and each further extending from the top edge to the bottom edge;

a first zipper track positioned at least within a portion of the top edge and within portions of the two spaced apart edges;

a first zipper operably associated with the first zipper track, the first zipper selectively movable along the first zipper track to provide access to the pocket through any of the top or two spaced apart edges;

a second zipper track positioned at least within the bottom edge; and a second zipper operably associated with the second zipper track, the second zipper selectively movable along the second zipper track to provide access to the pocket through the bottom edge.

2. The carry-on case of claim 1 wherein said second zipper track is closed securely by a securing feature.

3. The carry-on case of claim 2, wherein the security feature comprises a hook and snap lock selectively engageable with the second zipper.

4. The carry-on case of claim 3, wherein the second zipper includes a keyhole configured to receive a portion of the hook and snap hook therethrough.

5. The carry-on case of claim 1 further comprising a telescoping towing handle and wheels for ease of transportation.

6. The carry-on case of claim 5 wherein said wheels are castor wheels.

7. The carry-on case of claim 1, wherein portions of the bottom edge and one of the spaced apart side edges define a textile gusset.

8. The carry-on case of claim 1, wherein the body includes a tapered upper portion.

9. The carry-on case of claim 8, wherein the tapered upper portion is shaped for receipt within a curved area defined by an aircraft overhead compartment.

10. A method for accessing items within a carry-on case comprising a body including a main packing compartment and a lid that provides access to the main packing compartment; a pocket defined by the lid and a panel spaced apart from the lid, a top edge that extends between the lid and the panel, a bottom edge that extends between the lid and the panel, and two spaced apart edges, each extending between the lid and the panel and each further extending from the top edge to the bottom edge; a first zipper track positioned at least within a portion of the top edge and within portions of the two spaced apart edges, and a second zipper track positioned at least within the bottom edge, the method comprising:

selectively moving a first zipper operably associated with the first zipper track along the first zipper track to access the pocket through any of the top or two spaced apart edges; and selectively moving a second zipper operably associated with the second zipper track along the second zipper track to access the pocket through the bottom edge.

11. The method of claim 10 further comprising selectively securing the second zipper with a securing feature to maintain a closure of a bottom edge of said pockets so that the items contained within the pocket do not exit the pocket when the case is shifted from a resting position to an upright position.

12. The method of claim 10 further comprising transporting said case by use of a telescoping towing handle and wheels.

13. The method of claim 12 wherein said step of transporting said case comprises use of castor wheels.

14. The method of claim 10 further comprising includes transporting said case using a shoulder strap.

15. The method of claim 10 wherein said case comprises a backpack, said backpack being transportable by at least one backpack strap.

* * * * *

UNITED STATES PATENT AND TRADEMARK OFFICE

CERTIFICATE OF CORRECTION

PATENT NO. : 7,900,758 B2
APPLICATION NO. : 10/589631
DATED : March 8, 2011
INVENTOR(S) : William L. King et al.

It is certified that error appears in the above-identified patent and that said Letters Patent is hereby corrected as shown below:

On the Title page, Related U.S. Application Data, Item (60) insert:

--Provisional application No. 60/545,287, filed on February 17, 2004--.

Signed and Sealed this
Nineteenth Day of April, 2011

David J. Kappos

David J. Kappos
*Director of the United States Patent and Trademark Office*